United States Patent [19]

Lichtblau

[11] Patent Number: 4,886,418

[45] Date of Patent: Dec. 12, 1989

[54] BLOWER FOR DELIVERING COOLING AIR TO INTERNAL COMBUSTION ENGINES

[75] Inventor: Leo Lichtblau, Cologne, Fed. Rep. of Germany

[73] Assignee: Kloeckner-Humboldt-Deutz AG, Fed. Rep. of Germany

[21] Appl. No.: 279,661

[22] Filed: Dec. 5, 1988

[30] Foreign Application Priority Data

Dec. 17, 1987 [DE] Fed. Rep. of Germany ..... 3742841

[51] Int. Cl.[4] ..... F04D 29/60

[52] U.S. Cl. ..... 415/912

[58] Field of Search ..... 415/912, 914, 199.4, 415/199.5, 214.1

[56] References Cited

U.S. PATENT DOCUMENTS

| | | | |
|---|---|---|---|
| 2,861,738 | 11/1958 | Rundle | 415/207 |
| 3,146,007 | 8/1964 | Boivie et al. | 415/218.1 |
| 3,168,048 | 2/1965 | Toyokura et al. | 415/207 |
| 3,173,604 | 3/1965 | Sheets et al. | 415/207 |
| 3,338,049 | 8/1967 | Fernberger | 415/169.1 |
| 3,935,625 | 2/1976 | Saterdal | 415/912 |
| 4,668,166 | 5/1987 | Lutz | 415/912 |

FOREIGN PATENT DOCUMENTS

| | | | |
|---|---|---|---|
| 3406877 | 7/1984 | Fed. Rep. of Germany | 415/912 |
| 702312 | 1/1954 | United Kingdom | 415/129 |

*Primary Examiner*—Robert E. Garrett
*Assistant Examiner*—John T. Kwon
*Attorney, Agent, or Firm*—Charles L. Schwab

[57] ABSTRACT

A single stage axial blower design provides a series of blowers producing a wide range of delivery flow rates even though they have the same outer dimension, drive speed and guide wheel. This is achieved by a structural combination which includes a stationary guide vane wheel (5) of fixed design and impellers (8) which have varying hub diameters (9, 9*a*, 9*b*) but the same outer diameter. Thus, a series of blowers having the same external dimensions and the same stationary guide vane structure can be used with a series of air-cooled internal combustion engines which differ from one another in number of cylinders and related cooling requirements.

9 Claims, 1 Drawing Sheet

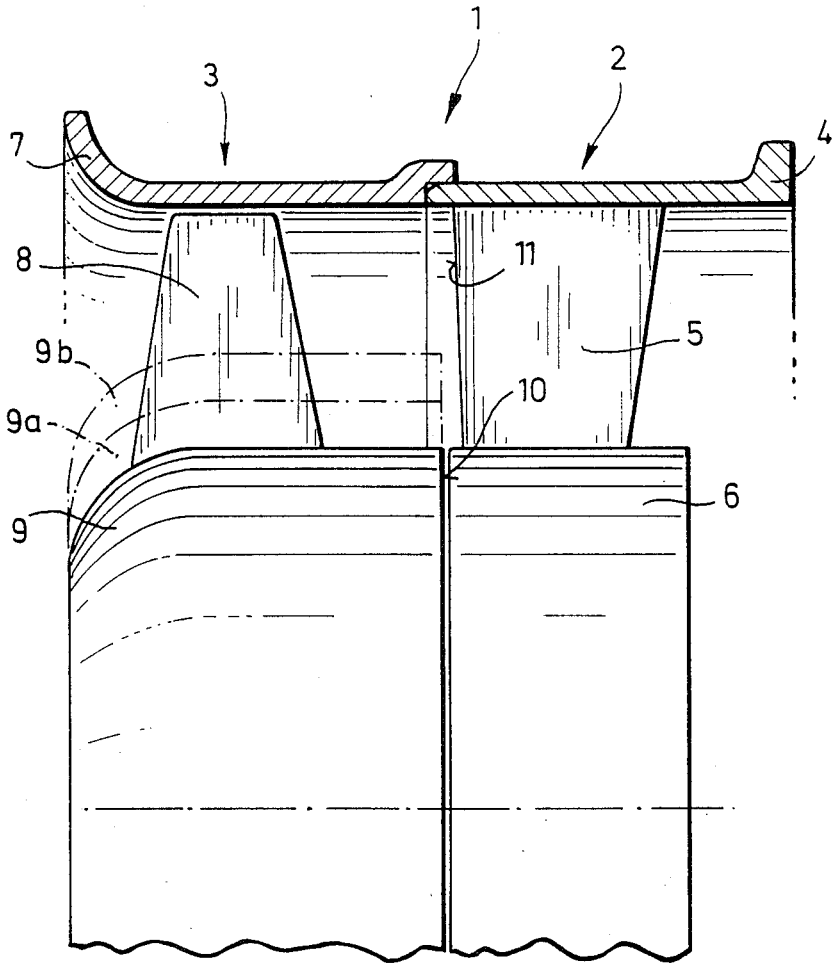
1
2
3
4
5
6
7
8
9
9a
9b
10
11

BLOWER FOR DELIVERING COOLING AIR TO INTERNAL COMBUSTION ENGINES

TECHNICAL FIELD

This invention relates to a single stage axial blower for delivering cooling air to a family of piston-type internal combustion engines.

BACKGROUND AND PRIOR ART STATEMENT

It has been found that piston-type internal combustion engines, which are designed in accordance with unit construction principles and are directly or indirectly air-cooled, require cooling air flow proportional to the number of cylinders and, as the case may be, to the cooling performance of additional heat exchangers or coolers, while the necessary cooling air pressure is only slightly dependent upon the number of cylinders and the additional coolers. Since it is not economical to develop and fabricate a distinct blower for each engine in a series or family of engines having a different number of cylinders and different auxiliary cooler arrangements, one is forced to find compromise designs for blowers which aim toward the lowest possible number of blower sizes for a given range of variation in the number of cylinders and the performance requirements of additional coolers in the engine series.

There exist known axial blowers which are designed in accordance with the unit construction principles to meet the varying requirements for volume delivery, delivery pressure, speed and outside diameter. In such blowers the outside diameter, hub diameter and blade height are varied independently, or in reasonable combinations, with the variation from blower to blower always changing both the impeller and guide wheel. Because of this, these blowers have, in spite of the principle of unit construction, the disadvantage of a considerable number of distinct design components which is especially disadvantageous when the blower components are pressure-die cast.

OBJECTS AND BRIEF SUMMARY OF THE INVENTION

An object of this invention is to provide a blower construction which, with a delivery pressure which is substantially constant, is capable of providing a wide range of air delivery quantities to a series of engines with the least possible number of design components.

This objective is met by equipping a series of engines with blowers having different air delivery rates but having identical guide wheels. Since the guide wheel is simultaneously designed as a blower support, and thus is a great deal more expensive than the impeller, the solution provided by this invention offers a significant cost advantage. It also provides for the utilization for a single blower speed, whereby the driving of the blower is standardized and thus less expensive. The impellers are design components which are relatively simple and inexpensive to fabricate. Thus, production of several design impellers can be accomplished at little increase in cost. This is particularly true for the variation of the impellers in accordance with the illustrated embodiment of the invention. The various impellers operating at the same speed produce an approximately steady air velocity but different air delivery rates with the varying diameter impeller hubs while retaining an air inflow angle which is most favorable for the standard guide wheel.

The delivery of the desired quantity of air to the family of engines is accomplished at the desired air velocity through the reduction of the impeller blade height while maintaining a substantially constant blower speed. This solution is particularly advantageous in the case of blowers for engines requiring relatively low flow rates of cooling air which heretofore were equipped with blowers with short impeller blades and attendant lower blower efficiency.

Blowers constructed in accordance with this invention have the same inflow air angle to the standard guide wheel whether the latter is fully loaded or partially loaded, as determined by the impeller hub diameter. Thus, the required level of air pressure is achieved even though the blower delivery quantities are different for blowers with different hub diameters. This invention provides a blower design in which there are a minimum number of costly and difficult to assemble components. Optimal flow rates are obtained with the various impeller blade heights.

BRIEF DESCRIPTION OF THE DRAWING

Additional characteristics of the invention can be found in the following description and in the drawing in which a partial section of a blower incorporating one embodiment of the invention is illustrated.

DETAILED DESCRIPTION OF THE DRAWING

Referring to the drawing, a single stage axial flow cooling blower 1 includes a stationary guide vane wheel 2 and a rotary axial flow impeller 3. The fixed design guide vane wheel 2 consisting of a guide wheel ring 4, guide wheel blades 5 and a guide wheel hub 6, which preferably are an integral unit, may be formed in a pressure die casting together with a front engine cover which is not shown.

The rotary bladed impeller 3 includes flow optimizing impeller blades 8 and an impeller hub 9 or one of the hub variations shown by broken lines **9*a* or 9*b*. The impeller 3 is a one-piece casting and is surrounded by a stationary cover ring 7 with a small radial clearance with the impeller blades 8. The inner contour of the cover ring 7 makes a smooth transition to the inner contour of the axially adjacent stationary guide wheel ring 4. The inner diameters of the coaxial rings 4, 7 are substantially the same and the rings 4, 7** are rigidly secured to one another to form an axially continuous annulus.

The blower 1 functions in the following way:

The impeller 3 with its impeller hub 9 and the axially adjacent and coaxial guide vane wheel 2 are designed optimally for the greatest air flow quantity required to cool, for example, a four-cylinder engine. For a three-cylinder engine and its corresponding lower needs for cooling air, the impeller hub **9*a* is used. The impeller hub 9*a* is dimensioned in such a way that the air velocity of the flow in the impeller corresponds approximately to the air velocity speed of the blower when using the hub 9. When the hub 9*a* is used, a radially inner part of the impeller blade 8 is eliminated and the remaining part of the blade remains the same. The same characteristics are true for impeller hub 9*b***, which is used in a blower for a two-cylinder engine.

All impeller hubs extend axially until their trailing sealing edge 10 is closely adjacent to the front edge 11 of the guide wheel blades 5 which results in a forced or positive guidance of the air flow to the blades 5. Because of inertia, the flow within the partially loaded standard guide wheel 5 for the most part follows the contour of the impeller hub 9*a* or 9*b* so that maintenance of the desired inflow angle to the loaded portions of the blades of guide wheel 5 is assured. By maintaining the same inflow angle and blower speed, the same air velocity is obtained and an approximately equal pressure level is achieved, thus providing a high degree of blower efficiency. There is an additional advantage in that the cross-sectional change in the air passageway through the blower 1 takes place in the manner of a multi-step diffuser in two steps and thus contributes to lower impact losses. Thus, minor discontinuities in the degree of efficiency in the flow grid, caused by the lack of flow guidance when using hub 9*a* or 9*b*, is for the most part compensated for by lower impact losses.

This invention makes it possible to use a common guide wheel for a complete engine design series which can be inexpensively fabricated as a single pressure die-cast component together with a front engine cover. This leads to a decrease in the number of components and considerably lowers costs in production of engines.

The embodiments of the invention in which an exclusive property or privilege is claimed are defined as follows:

1. A single stage axial flow blower of the type having a series of interchangeable rotary bladed impellers and an axially adjacent stationary guide vane wheel, said blower delivering cooling air to a piston-type air-cooled internal combustion engine with any one of a series of 2 to 4 numbers of cylinders wherein the dimensioning of the impeller is varied to attain a rate of cooling air flow for the engine with which used while retaining the same air delivery pressure and blower speed, a stationary ring (7) surrounding said impeller, said guide vane wheel including a guide wheel hub, guide vanes extending radially outward from said hub and a radially outer ring surrounding said guide vanes and extending axially in end-to-end relation to said stationary ring, the inner diameters of said rings being substantially equal, one of said series of said impellers including a hub (9) having an outer diameter substantially equal to the outer diameter of said wheel hub (6) when said blower is installed in said engine with four cylinders and the other of said series of said impellers having a larger outer diameter hub than said diameter of said wheel hub when said blower is installed on an engine having less than four cylinders.

2. The blower of claim 1 wherein said impeller hub includes a sealing edge having a slight axial clearance with said guide vane wheel (2).

3. The blower of claim 2 wherein said rings are joined together to form a standard part common to blowers for said series of engines.

4. The blower of claim 3 wherein each impeller includes flow optimizing blades formed by being cast integrally with its impeller hub (9, 9*a*, 9*b*).

5. The blower of claim 1 wherein said rings are rigidly secured together at their axially adjacent ends to form an axially continuous annulus.

6. The blower of claim 1 wherein each impeller includes a one-piece casting having flow optimizing blades and an impeller hub.

7. The blower of claim 6 wherein said rings are joined together at axially adjacent ends to form an axially continuous annulus.

8. The blower of claim 6 wherein said impeller hub (9, 9*a*, 9*b*) includes a sealing edge having a slight axial clearance with said guide vane wheel.

9. A single stage axial flow blower for supplying cooling air to an air-cooled piston-type internal combustion engine comprising:

a stationary guide vane wheel having a wheel hub of fixed outer diameter, an outer ring spaced radially from and coaxially surrounding said wheel hub and vanes secured to and extending radially between said wheel hub and said outer ring, a rotary impeller in coaxial adjacent relation to said guide vane wheel including an impeller hub with a trailing sealing edge in slightly spaced relation to the adjacent guide vane wheel and impeller blades secured to and extending radially outward from said impeller hub and a stationary cover ring in radially outward and coaxial surrounding relation to said impeller having an inner diameter substantially the same as the inner diameter of said guide vane ring, said cover ring being rigidly attached to and extending in axial continuation of said guide vane ring to form an annulus, said blower being so proportioned, constructed and arranged to receive any one of a series of impellers of the same outside diameter but different hub diameters so as to produce cooling air flow rates corresponding to the cooling needs of engines which differ from one another in number of cylinders.

* * * * *